US005244161A

United States Patent [19]

Wirtz-Odenthal

[11] Patent Number: 5,244,161

[45] Date of Patent: Sep. 14, 1993

[54] APPARATUS FOR PAYING OUT WEB SECTIONS

[75] Inventor: Bernhard Wirtz-Odenthal, Korschenbroich, Fed. Rep. of Germany

[73] Assignee: Scott-Feldmühle GmbH, Dusseldorf, Fed. Rep. of Germany

[21] Appl. No.: 768,643

[22] PCT Filed: Feb. 8, 1991

[86] PCT No.: PCT/EP91/00245

§ 371 Date: Oct. 1, 1991

§ 102(e) Date: Oct. 1, 1991

[87] PCT Pub. No.: WO91/11946

PCT Pub. Date: Aug. 22, 1991

[30] Foreign Application Priority Data

Feb. 10, 1990 [DE] Fed. Rep. of Germany ..... 4004122

[51] Int. Cl.[5] ..... B65H 16/02

[52] U.S. Cl. ..... 242/55.3

[58] Field of Search ..... 242/55.3, 55.53, 58.2; 312/34.22

[56] References Cited

U.S. PATENT DOCUMENTS

| | | | |
|---|---|---|---|
| 4,236,679 | 12/1980 | Jespersen | 242/55.3 |
| 4,307,638 | 12/1981 | DeLuca et al. | 242/55.3 |
| 4,756,485 | 7/1988 | Bastian et al. | 242/55.53 |

FOREIGN PATENT DOCUMENTS

| | | |
|---|---|---|
| 0116508 | 8/1984 | European Pat. Off. . |
| 0206952 | 12/1986 | European Pat. Off. . |
| 0235446 | 9/1987 | European Pat. Off. . |
| 0319166 | 6/1989 | European Pat. Off. . |
| 18289 | 11/1881 | Fed. Rep. of Germany . |
| 2132756 | 3/1972 | Fed. Rep. of Germany . |
| 2623120 | 6/1977 | Fed. Rep. of Germany . |
| 2812756 | 10/1978 | Fed. Rep. of Germany . |
| 2838913 | 3/1979 | Fed. Rep. of Germany . |
| 2387627 | 11/1978 | France . |

*Primary Examiner*—Daniel P. Stodola
*Assistant Examiner*—John P. Darling
*Attorney, Agent, or Firm*—Brumbaugh Graves Donohue & Raymond

[57] ABSTRACT

In an apparatus for paying out web sections (50), comprising a dispenser roll (38) and a supply roll (40), a feeler (31) resting on the dispenser roll (38) determines the diameter thereof and, by way of levers, unlocks a detent (28) or a protrusion (78) disposed at a swinging plate (27) which carries the bearings (24). Hereby the swinging plate (27) is swung by a spring (48, 79) and thus the supply roll (40) resting on the bearing (24) is pressed against the paper web (39) withdrawn from the dispenser roll (38) and, together with it, against the toothed roller (21). Hereby the last rest of paper from the dispenser roll (28) is pulled off simultaneously with the leading end (41) of the web from the supply roll (40).

7 Claims, 8 Drawing Sheets

APPARATUS FOR PAYING OUT WEB SECTIONS

Figure 1:
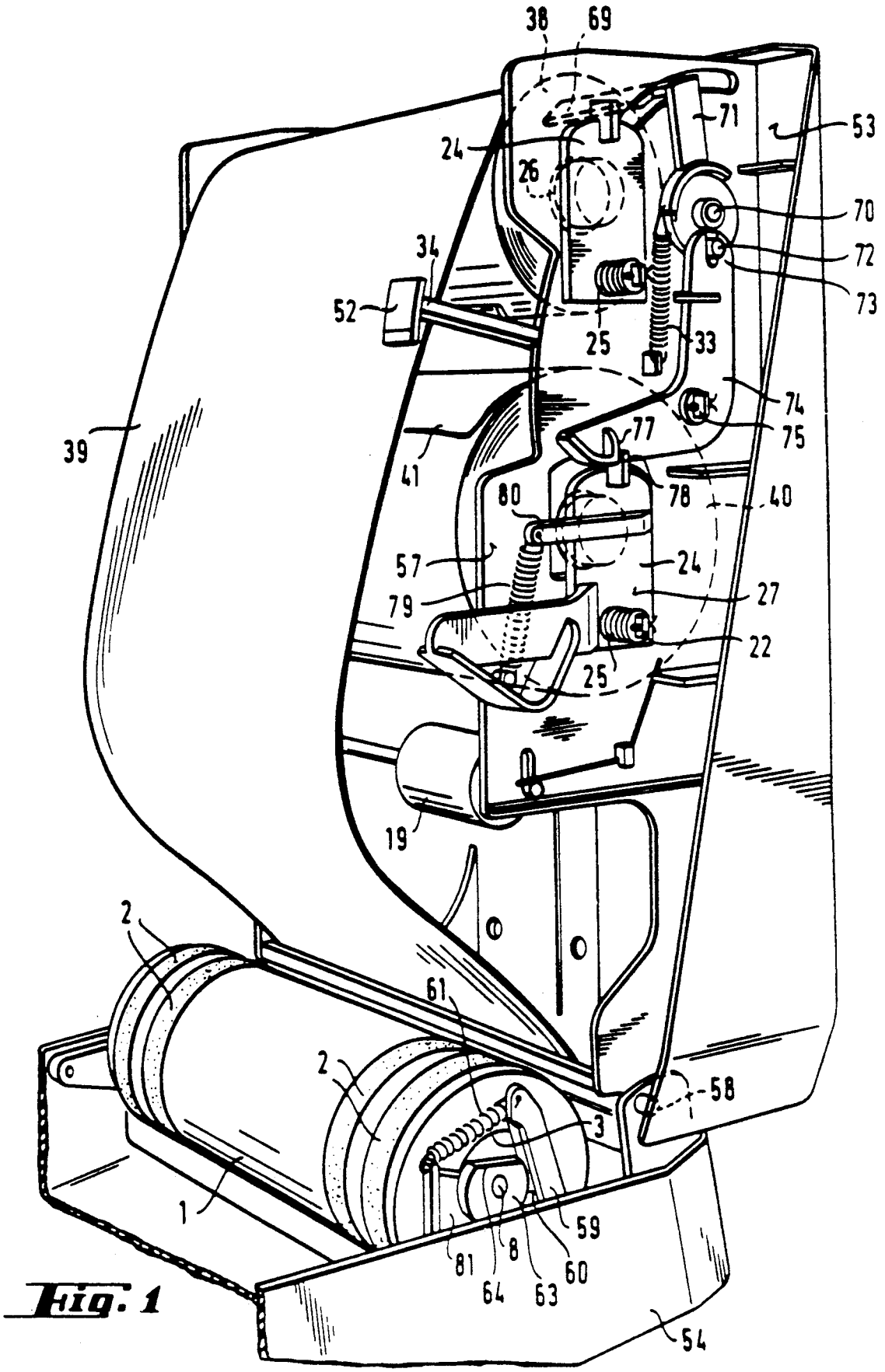

The invention relates to an apparatus for paying out web sections, especially paper towels from a dispenser roll, comprising automatic changeover of the dispensing to a supply roll upon exhaustion of the dispenser roll, wherein a feeler in contact under spring loading with the web of material of the dispenser roll detects the presence of the web of material of the dispenser roll and, in case of absence thereof, presses the end of the web of material of the dispenser roll by way of a lever structure against the beginning of the web of material of the supply roll and feeds both webs of material in common to a contact pressure roller and the counter-roller in engagement with the same.

Sheet dispensers working from a roll are known in great number. The most significant ones, apart from dispensers of cleaning rags and cloths, have become dispensers of towels. For this reason the invention will be discussed below with reference to the example of a towel dispenser without, however, restricting it thereto.

Towel dispensers which are equipped with a supply roll and with which this extra roll is resorted to when the paper supply on the first roll is exhausted are known from U.S. Pat. No. 4,236,679, EP-OS 319 166, EP-OS 235 446, and DE-OS 28 12 756. According to U.S. Pat. No. 4,236,679 it is suggested to arrange the material rollers above each other on hingedly suspended supporting levers, whereby they are in contact with each other, and to support the lower roller on a transport roll. Upon exhaustion of the lower web of material roll the supporting levers swing back and the roll in reserve takes the place of the first dispenser roll. It is not assured in this case that the beginning of the web of the extra roll actually will exit downwardly from the dispenser.

EP-OS 319 166 provides for dispensing web material by means of a slide surface actuated by a rack, the material of the first roll being wrapped around the slide surface and leads to the removal opening. At the same time, the leading end of the web of the second roll is placed on the slide surface and pressed against the transport roll by a contact pressure plate. The contact pressure plate includes detents by which the leading and of the second paper roll is held. When the first paper roll is unwound the frictional resistance between the beginning of the web of the second paper roll and the transport roll is increased due to the greater friction of the transport roll, whereby the paper is pulled across the detents and gets to the exit opening. In view of the fact that the friction may vary considerably, depending upon the type of paper inserted, it cannot be warranted that paper is not withdrawn already from the second roll, too, while there still is paper to be dispensed from the first roll. Thus it may well happen that two sheets are paid out, i.e. that the consumption of paper is doubled.

A changeover mechanism may be taken from EP-OS 235 446 with which a feeler connected to a lever system senses the diameter of the first roll and, as the decrease in diameter augments, moves a contact pressure roll by way of the lever system to the transport roll over which the paper is guided. Below the contact pressure roll, the leading end of the web of the replacement roll is supported at a fixed point and pressed against the transport roll when the first roll essentially has been unwound, whereby material can be unwound from the spare roll. With this structure it is not guaranteed that the beginning of the web of the replacement roll always can be grasped, nor is it guaranteed that it is not withdrawn unintentionally together with the first web.

DE-OS 28 12 756 describes a towel dispenser with which the first paper roll is disposed above the spare roll, the web to be withdrawn being guided along a spring loaded feeler between two spaced apart rollers to a transport and counter-pressure roller and from the latter to the removal opening. The web to be paid out is kept under tension between the first roll and the transport roll, the leading end of the second paper roll being introduced into the roller nip. One roller of the rollers forming the nip is supported on the feeler lever. Therefore, if the paper web is missing between the first roll and the contact pressure or slide surface, a spring urges the feeler in the direction of the empty winding tube of the first paper roll, thus pressing the end of the web of the first paper roll in the nip against the beginning of the web of the second paper roll which consequently can be pulled along. It is disadvantageous in this case that the contact pressure in the nip must be relatively high in order for the second paper web to be taken along. That in turn makes it a condition that nothing but paper of high tearing strength be used since the feeler does not keep the nip open unless it is pressed back by the first paper web against the pressure of the spring. The mere influence of moisture from the humidity of the air changes the characteristic of the paper, i.e. it expands so that the tension of the web originally given no longer exists, the feeler is pressed by the spring in the direction of the first paper roll so that the roller nip is diminished unintentionally and thereby the simultaneous paying out of paper from the second roll is initiated.

It is the object of the instant invention to avoid the disadvantages described above.

In an apparatus for paying out web sections, especially paper towels from a dispenser roll, comprising automatic changeover of the dispensing to a supply roll upon exhaustion of the dispenser roll, wherein a feeler in contact under spring loading with the web of material of the dispenser roll detects the presence of the web of material of the dispenser roll and, in case of absence thereof, presses the end of the web of material of the dispenser roll by way of a lever structure against the beginning of the web of material of the supply roll and feeds both webs of material in common to a contact pressure roller and the counter-roller in engagement with the same, this problem is solved by the combination of the following features:

- the feeler rests on the dispenser roll and unlocks a detent or a protrusion of a swinging plate by way of levers,
- the swinging plate carries a bearing and can be moved about a pivot pin by means of a spring,
- the spring turns the swinging plate with the supply roll resting on the bearing against a toothed roller,
- the toothed roller presses the end of the web of material of the dispenser roll against the leading end of the web of the supply roll.

During the unwinding process of the paper web from the dispenser roll which, being the first roll, is disposed above the extra roll the paper web to be withdrawn is guided along the supply roll at a spacing from the toothed roller. According to a preferred embodiment of the invention the supply roll is blocked by a brake during this time and, therefore, any unwinding of the paper is securely prevented. When the dispenser roll has been unwound, except for a few layers, a lever mechanism releases the arrest of a swinging plate which carries a bearing of the supply roll, the swinging plate, including the bearing and supply roll, is pressed by spring pressure against the paper web being withdrawn from the dispenser roll and together with it against the toothed roller, becoming disengaged from the brake due to this movement. Further pulling of the paper web from the first roll, i.e. the dispenser roll, causes rotation of the supply roll which is not locked any more, i.e. the beginning of the web of the supply roll is unwound together with the paper web of the dispenser roll, fed over a contact pressure roller to the apportioning roller and pulled off together from the same.

From two to four web sections of double layered nature are dispensed until the paper on the dispenser roll has been used up altogether, that is necessary for the safe functioning of the dispenser.

Advantageous modifications of the invention provide for the feeler to be pressed against the dispenser roll by means of a feeler spring, the feeler conveniently being connected to a holding rod by way of a joint pin. The holding rod is supported preferably in a holding rod guide member and is in engagement with a detent of the swinging plate.

The spring which presses the feeler against the dispenser roll at the same time is the actuating member for the holding rod, i.e. it pulls the holding rod in upward direction as the diameter of the dispenser roll gets smaller so that the end of the holding rod approaches the rod guide member, thereby releasing the detent of the swinging plate. It is only upon release that the supply roll can be swung and thus the dispensing of web sections be switched over from the dispenser roll to the supply roll.

An alternative solution of the combination of feeler/-holding rod/detent provides that the feeler is made of a flat profile piece which comprises a slide piece and engages in a control fork of an L-shaped piece by way of a peg, the L-shaped piece conveniently being swung about a supporting pin and being adapted to be engaged with the protrusion of the swinging plate. With this structure, too, the feeler scans the roll diameter of the dispenser roll, the slide piece lieing on the dispenser roll. As the diameter of the dispenser roll diminishes, the feeler moves in the direction of the roll center, whereby the peg located opposite the slide piece in the control fork of the L-shaped piece pivots the L-shaped piece so that the protrusion of the swinging plate no longer is in connection with the L-shaped piece when the dispenser roll is practically unwound. That provides the same solution, i.e. the dispenser roll separates from the brake and is pressed against the toothed roller, whereby the paying out of web sections from the supply roll is initiated.

The invention will be described below with reference to the drawings.

Figure 2:
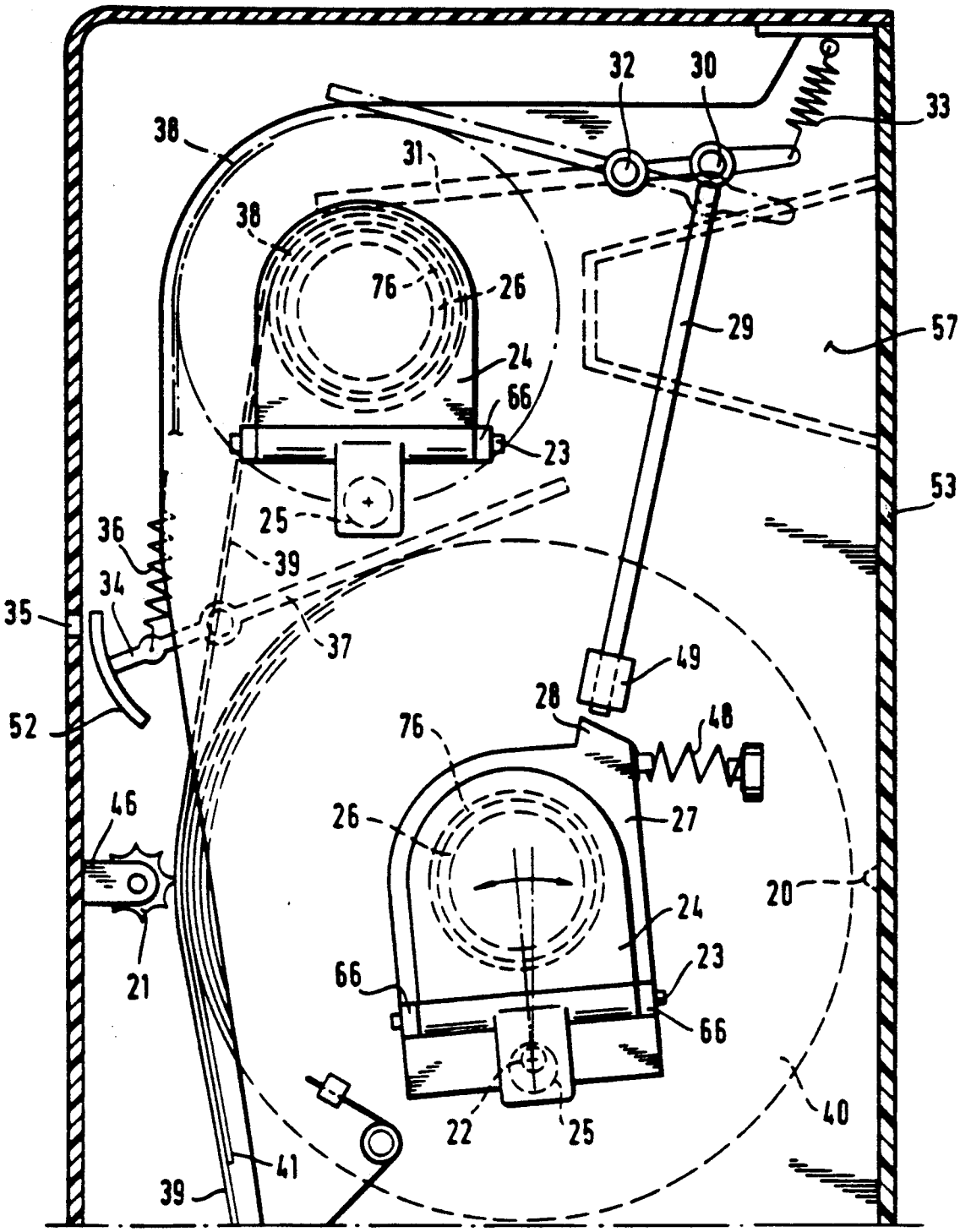
Figure 3:
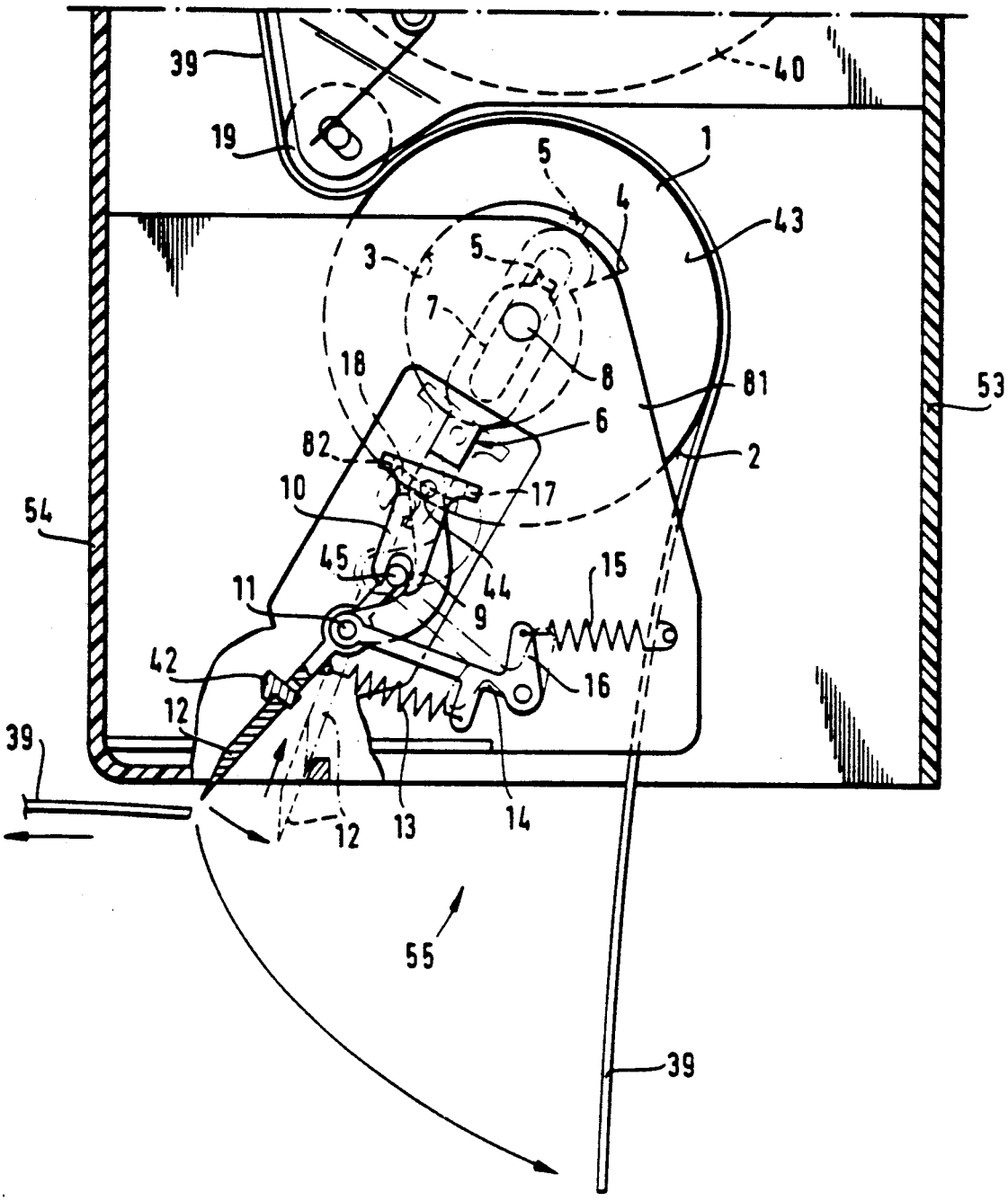
Figure 4:
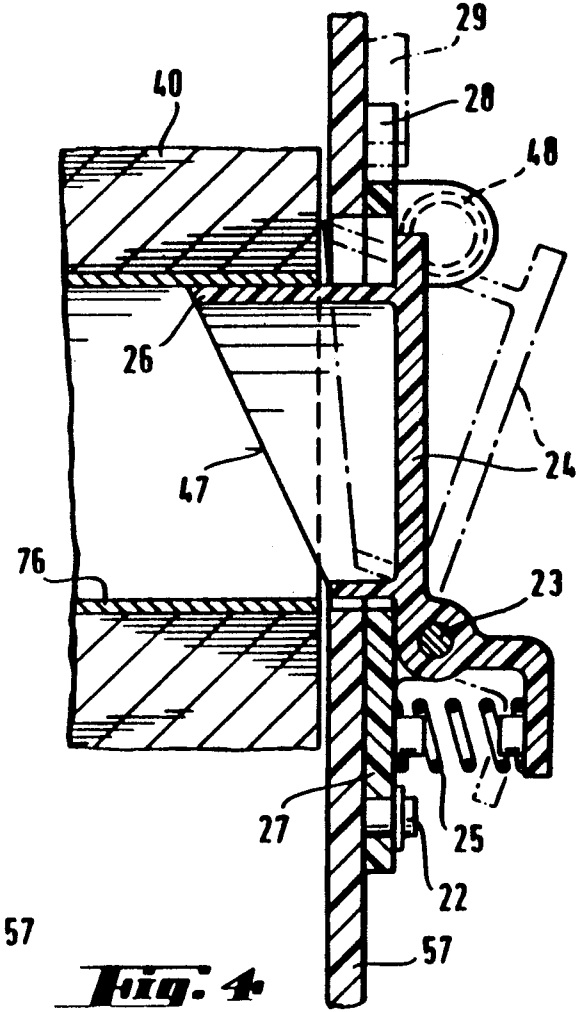
Figure 5:
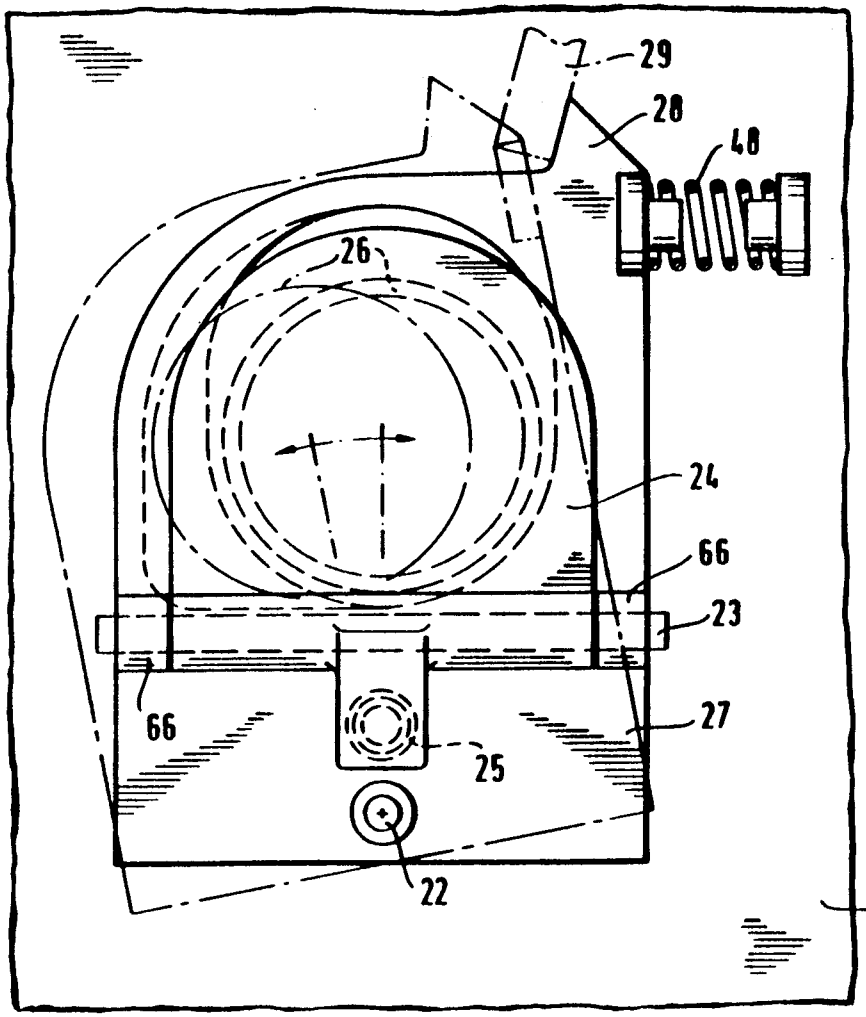
Figure 6:
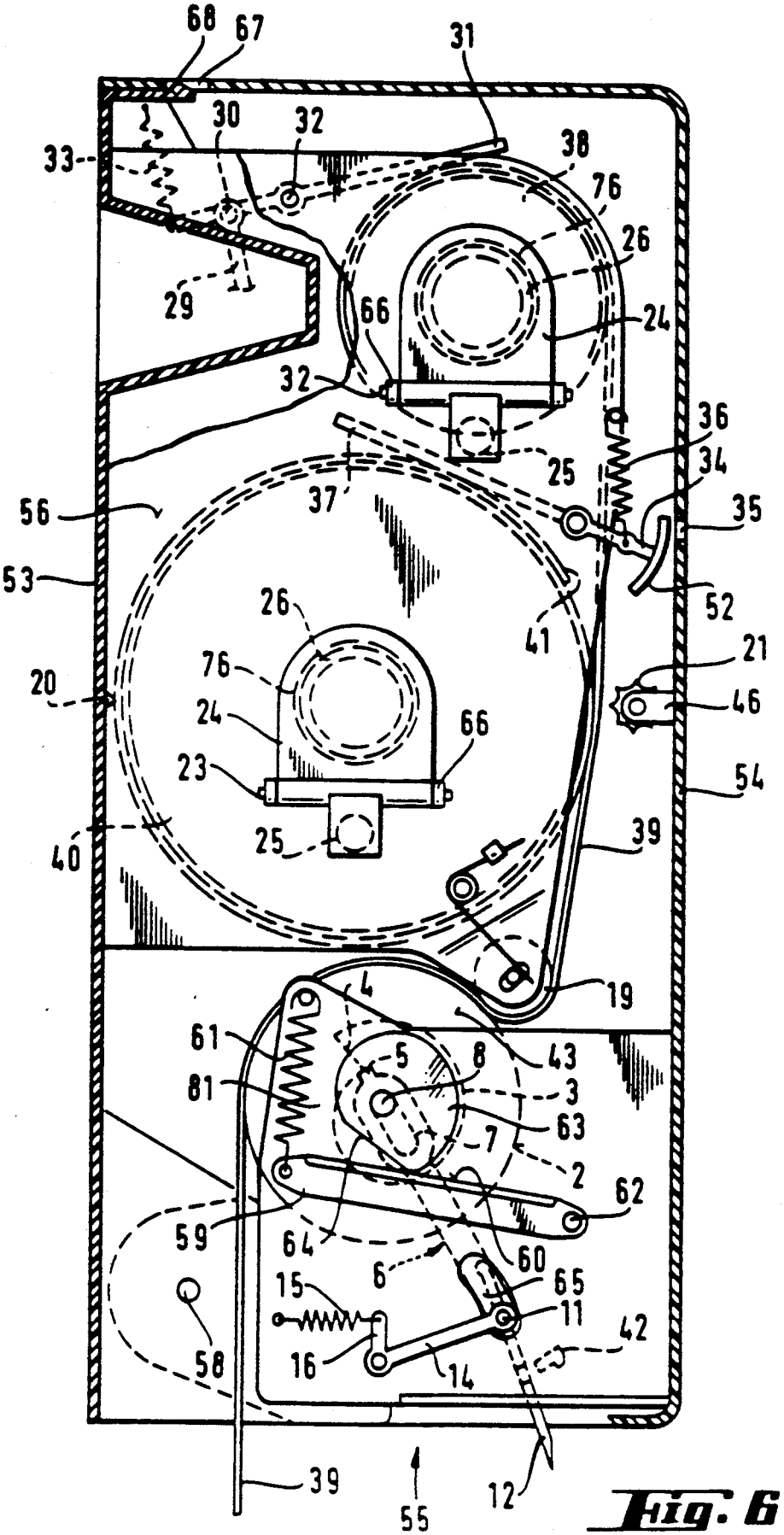
Figure 7:
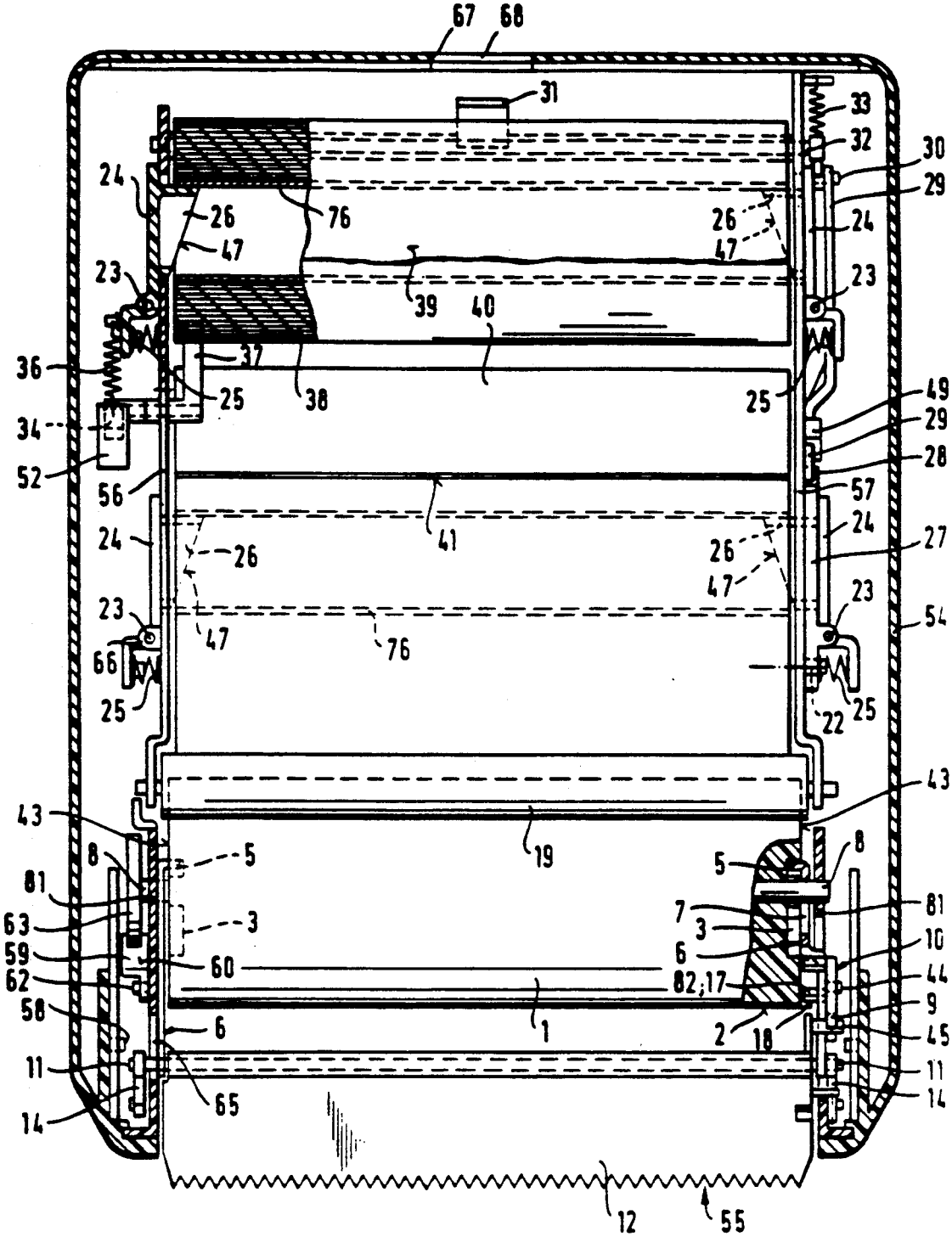
Figure 8:
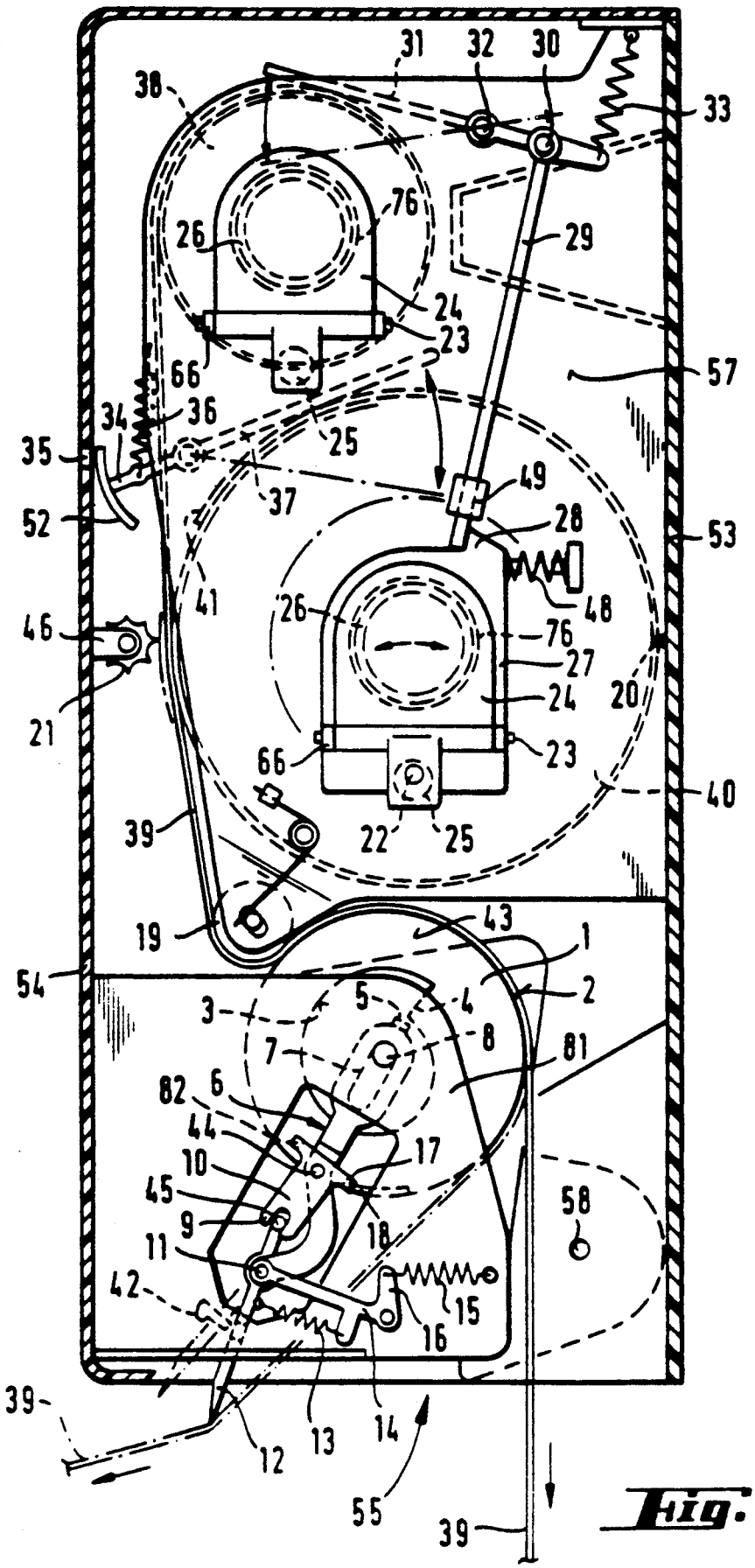
Figure 9:
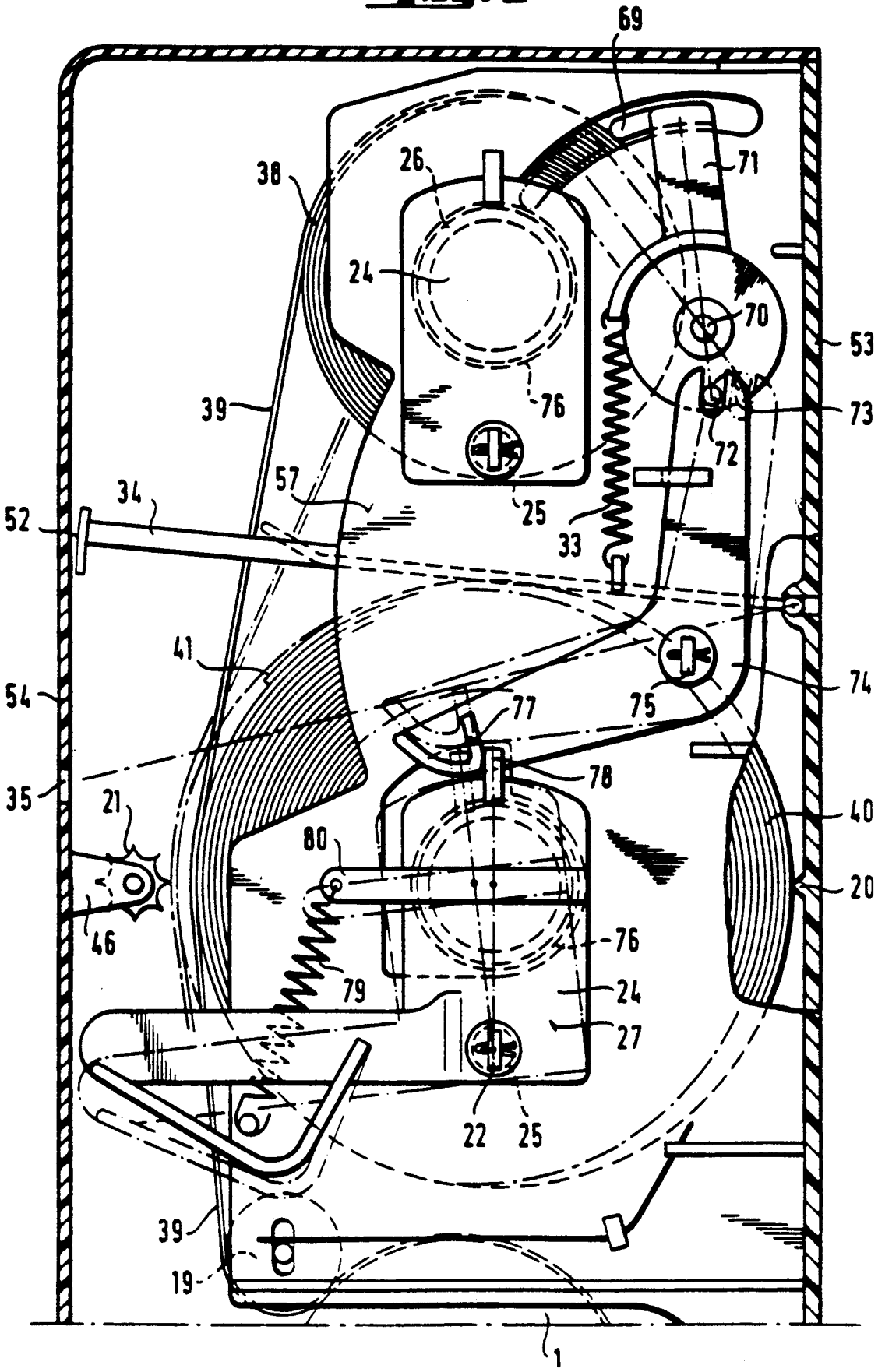

FIG. 1 shows the perspective presentation of a towel roll dispenser,

FIG. 2 two dispenser rolls arranged on top of each other in an enlarged partial side view from the right, FIG. 3 the cut-off mechanism of the paper web, FIG. 4 and FIG. 5 a tilting bearing in detail, FIG. 6 a side elevation of the dispenser from the left, FIG. 7 the front view of the dispenser, FIG. 8 the side elevation of the dispenser from the right, FIG. 9 an alternative solution of FIG. 8.

An apportioning roller 1 provided with a friction lining 2 is disposed in the lower range of the sheet distributor. The end faces of the apportioning roller 1 comprise a spiral guide 3 each engaged by a nose 5 of a thrust member 6. By its oblong aperture 7 the thrust member 6 surrounds the shaft 8 of the apportioning roller 1. When the apportioning roller 1 is moved in clockwise sense by pulling of the paper web 39, the nose 5 rides in the spiral guide 3, thereby moving the thrust member 6.

At the end opposite the nose 5, the thrust member 6 which is of elbow shape in its lower range includes a joint 11 which connects it to the knife 12 and the knife lever 14 which is pivotably supported on the bearing blocks 81 of the apportioning roller 1 and passes through the cutout 65 formed in the bearing blocks 81. The knife 12 embodied by a serrated knife blade projects beyond the joint 11 by its rear portion where it comprises knife bolts 45 engaging in the forks 9 of the release anchor 10.

The release anchor 10 which is connected in articulated fashion to the thrust member 6 by a stay bolt 44 includes a stopper surface 17 at the outside at one anchor face and the inner stopper surface 82 at the inside at the other anchor face. When the paper web 39 is pulled off over the apportioning roller 1 the latter is rotated. The stops 18 provided on its end surfaces 43 thus hit the stopper surfaces 17 of the release anchors 10 which cooperate with both end surfaces 43. In this arrest position of the apportioning roller 1 one web length has been payed out. At the same time the thrust member 6 has moved into its outermost position, whereby the knife 12 was moved outwardly and consequently into the area of the paper web 39 which was pulled out. The knife 12 now engages the paper web 39. Further pulling causes the paper web 39 to be severed, releasing web section 50. Simultaneously the knife is moved against the direction of spring pressure of the knife spring 13 until it stops at a return catch 42, whereby the release anchor 10 is rotated about the stay bolt 44 by means of the knife bolt 45 which engages in the fork 9 of the release anchor 10 so that the stopper surface 17 will lift off the stop 18. In this position the knife 12 is caught by the return catch 42 and will not be drawn back by the knife spring 13 until the web section 50 has been severed so that the knife 12 no longer is subjected to pull. Spring actuated advance, to be explained later on, rotates the apportioning roller 1 onwards by a few degrees in clockwise sense until the stop 18 abuts against the inner stopper surface 82 and arrests the apportioning roller 1 for the second time. Hereby a new length of the paper web 39 is passed out of the dispenser so that it can be grasped by hand. Together with this rotation, the nose 5 is guided in the spiral guide beyond the step 4 and the knife 12 is freed from the stopper 42 by the knife spring 13. The nose 5 thus can be returned into its starting position by the return spring 15 which acts on the leg 16 of the knife lever 14 so that the knife 12 is retracted once again.

The paper web 39 is on a dispenser roll 38 which is arranged in the upper part of the dispenser and rests on supporting studs 26. The supporting stud 26 consists of a pipe end which is given a downward slope and presents an integral part of a tilting bearing 24 pressed through the right 56 and left 57 inside walls, respectively, of the dispenser by a contact pressure spring 25 and connected to the same in a manner so as to be pivotable in and out by means of the swing bolt 23. The swing bolt 23 is received by solid journal bearings 66 arranged at the inside walls 56, 57.

The space between the inside walls 56 and 57 corresponds to the width of the dispenser roll 38. When the dispenser roll 38 is inserted, that is done from below, in other words along the slope 47 of the supporting studs 26 which thus tilt outwardly until the winding tube 76 of the dispenser roll 38 has been reached, in other words up to the time when the contact pressure spring 25 press the supporting studs 26 into the winding tube 76 of the dispenser roll 38. The diameter of the dispenser roll 38 is restricted by a limiter 51 arranged in the back wall 53 so that only dispenser rolls 38 can be introduced that have a defined maximum diameter.

A feeler 31 supported in a bearing bolt 32 rests on the dispenser roll 38 and is held in this contacting position by a feeler spring 33. A joint pin 30 connects the holding rod 29 with the feeler 31 the holding rod 29 being guided in a rod guide member 49. The lower part is in egangement with the detent 28 of a swinging plate 27 which can be moved about the pivot pin 22 and carries a tilting bearing 24. Withdrawal of the paper web 39 from the dispenser roll 38 reduces the diameter thereof so that the feeler 31 moves down continuously, whereby the holding rod 29 is pulled up until the holding rod 29 releases the detent 28, when the dispenser roll is almost empty, and the swinging plate spring 48 moves the swinging plate 27 and thus the tilting bearing 24 in the direction of the toothed roller 21.

At both its ends the supply roll 40 rests in tilting bearings 24. Yet one of these tilting bearings 24 is located on the swinging plate 27, i.e. the supply roll is pressed by the swinging plate spring 27 in one-sidely offset fashion against the toothed roller 21 which is supported in the toothed roller block 46. The brake 20 thus no longer engages the circumference of the supply roll 40 which, therefore, can rotate freely. The toothed roller 21 presses the paper web 39 coming from the dispenser roll 38 against the supply roll 40 so that the leading end 41 thereof is payed out from the supply roll 40 together with the paper web 39 being withdrawn, reaches the contact pressure rollers 19, and gets to the outlet opening 55 of the dispenser by being guided over the apportioning roller 1.

Two paper webs now are being dispensed simultaneously until the dispenser roll 38 is exhausted, in other words two sheets are removed when the paper web 39 is torn off across the knife 12. This doubling of the paper web 39 lasts until the dispenser roll is exhausted, i.e. in practice from two to five double sheets are dispensed before the unwinding takes place from the supply roll 40 alone.

The filling level lever 34 held in position by the filling level spring 36 rests on the supply roll 40 by way of a filling level feeler 37. In this area the cover 54 of the dispenser has a filling level window 35 through which the scale 52 of the filling level lever 34 is visible, thus the filling of the dispenser is visible from outside. The scale 52 is designed such that an alarm is given as early as when $\frac{2}{3}$ of the spare roll have been used up. If the container is refilled in this condition the partly unwound supply roll 40 now is exchanged for the empty winding tube 76 of the dispenser roll 38, and a new supply roll 40 is intro-duced into the dispenser.

Other than in FIGS. 2 to 8, the release mechanism for the supply roll 40 is of different structure in FIGS. 1 and 9. Here the scanning of the dispenser roll is effected by a slide piece 69 which rests on the dispenser roll 38, forms an integral member with a flat profile piece 71, is pivotable about the pin 70, and includes a peg 72 at the end opposite the slide piece 69. This peg 72 engages in the control fork 73 of an L-shaped piece 74 which is connected to the right inside wall 57 of the dispenser by a supporting pin 75. The front portion of the L-shaped piece 74 includes a hook stop 77 which snaps into engagement behind a protrusion 78 of the tilting bearing 24 arranged on the swinging plate 27.

As the paper web 39 is payed out from the dispenser roll 38 the diameter of the latter decreases so that the slide piece 69 moves in the direction of the winding tube 76. Hereby the flat profile piece 71 rotates with the peg 72 which moves the control fork 73 in the direction of the back wall 53 of the dispenser, thereby turning the L-shaped piece 74 so as to lift the hook stop 77 over the protrusion 78. The tension spring 79 connects a point of the right inside wall 57 with the arm 80 of the swinging plate 27 or tilting bearing 24, thereby pulling the supply roll 40 against the toothed roller 21.

The toothed roller 21 is mounted at the right side of the cover 54 in a toothed roller block 46 which forms an integral component part of the cover 54. The cover 54 is supported in cover bearings 58 which are located in the right and left inside walls 57, 56, respectively. In its upper portion, near the back wall 53, it has a holding slit 67 which is engaged by a resilient hook 68 disposed at the back wall.

The apportioning roller 1 is arranged on bearing blocks 81 in the lower part of the cover 54, thus being tilted forwardly when the cover 54 is swung away so that the paper web 39 can be passed conveniently between the contact pressure rollers 19 and the apportioning roller 1 upon roll replacement.

The shaft 8 of the apportioning roller 1 extends through one of the bearing blocks 81 and, at its outer end, carries a cam segment 63 which comprises a transport surface 64. The cam segment 63 engages the slide surface 60 of the transport lever 59 which is pressed against the cam segment by the transport spring 61. When the paper web 39 is withdrawn and, consequently, the apportioning roller 1 rotates, the cam segment 63 is rotated at the same time, i.e. the slide surface 60 which is on the transport surface 64 when the apportioning roller 1 is at rest slides along the circumference of the cam segment 63, moves the transport lever 59 down, thus tensioning the transport spring 61. The apportioning roller 1 is arrested at the moment when the maximum tensioning of the transport spring 61 is reached. That is effected by the stopper surface 17 of the release anchor 10 abutting against the stop 18 of the apportioning roller 1. The knife 12 swings back after the paper web 39 is torn off so that the locking is cancelled, i.e. the stop 18 and the stopper surface 17 are engaged no longer. As a result, the slide surface 60 rides along the transport surface 64, i.e. the transport spring 61 pulls the transport lever 59 into its inactive position, thus moving the apportioning roller 1 until the stop 18 engages the inner stopper surface 82. The knife 12, therefore, can glide back into its starting position, and another piece of the paper web 39 is transported to the outside.

What is claimed is:

1. An apparatus for paying out web sections from a supply roll having a web of material upon exhaustion of a web of material from a dispenser roll, said apparatus comprising:

means for receiving and paying out web sections from a web of material;

movable support means including bearing means for receiving said supply roll, said support means being movable between a first position in which said supply roll is spaced from the web of material from the dispenser roll and a second position in which the leading end of the web of material from the supply roll is in contact with said web of material from the dispenser roll;

detent means on said movable support means;

means including a spring-biased feeler resting on said dispenser roll as it dispenses web material, for engaging said detent means on said movable support means to retain said supply roll in said first position, said means being actuated in response to a position of said feeler prior to complete exhaustion of the web of material from said dispenser roll to disengage said detent means on said movable support means;

spring means for moving the bearing means from said first position to said second position upon disengagement of said detent means, thereby placing the leading end of the web of material from said supply roll in contact with the web of material from said dispenser roll; and means enabling the leading end of the web of material from said supply roll to be carried along with the remainder of the web of material from said dispenser roll to said means for receiving and paying out web sections.

2. The apparatus of claim 1, wherein the means enabling the leading end of the web of material from said supply roll to be carried along with the remainder of the web of material from the dispenser roll comprises a toothed roller.

3. The apparatus of claim 1, wherein the movable support means is a pivotable swinging gate having bearing means.

4. The apparatus of claim 1, wherein the spring biased feeler comprises a slide piece contacting the web of material of the dispenser roll.

5. The apparatus of claim 4, wherein the means for engaging the detent means comprises a segment piece coupled to the slide piece, a peg coupled to said segment piece, and a pivotable L-shaped engagement piece having a control fork end which engages said peg and an engagement end piece opposite said control fork end which engages the detent means prior to the exhaustion of the web of material of the dispenser roll.

6. The apparatus of claim 1, wherein the means for engaging the detent means comprises a joint pin, a holding rod coupled to the spring biased feeler by said joint pin, and holding a rod guide for guiding the holding rod into engagement with the detent means prior to the exhaustion of the web of material from the dispenser roll.

7. The apparatus of claim 1 further comprising brake means for engaging the supply roll prior to the exhaustion of the web of material from the dispenser roll.

* * * * *

UNITED STATES PATENT AND TRADEMARK OFFICE

CERTIFICATE OF CORRECTION

PATENT NO. : 5,244,161

DATED : September 14, 1993

INVENTOR(S) : Bernhard Wirtz-Odenthal

It is certified that error appears in the above-identified patent and that said Letters Patent is hereby corrected as shown below:

Col. 1, line 44, "and" should read -- end --;

Col. 5, line 18, "the holding" should read -- , the holding --;

Col. 8 line 25, "holding a" should read -- a holding --.

Signed and Sealed this

Nineteenth Day of April, 1994

*Attest:*

*Attesting Officer*

Bruce Lehman

BRUCE LEHMAN

*Commissioner of Patents and Trademarks*